US005848636A

United States Patent [19]

Chuang

[11] Patent Number: 5,848,636

[45] Date of Patent: Dec. 15, 1998

[54] COOLER

[76] Inventor: Yu-Cheng Chuang, No. 9, Chien Kang Rd., Hsin Shih Tainan Hsien, Taiwan

[21] Appl. No.: 12,595

[22] Filed: Jan. 23, 1998

[51] Int. Cl.[6] ..... F28D 1/06

[52] U.S. Cl. ..... 165/74; 165/73; 165/169; 165/162; 165/161

[58] Field of Search ..... 165/168, 169, 165/171, 162, 161, 74, 73

[56] References Cited

U.S. PATENT DOCUMENTS

| | | | |
|---|---|---|---|
| 2,552,635 | 5/1951 | Kleist | 165/74 X |
| 3,244,225 | 4/1966 | Nevins | 165/74 |
| 4,637,347 | 1/1987 | Troy | 165/74 X |

FOREIGN PATENT DOCUMENTS

| | | | |
|---|---|---|---|
| 67702 | 9/1948 | Denmark | 165/74 |
| 57-0090543 | 6/1982 | Japan | 165/74 |

*Primary Examiner*—Ira S. Lazarus
*Assistant Examiner*—Christopher Atkinson
*Attorney, Agent, or Firm*—Rosenberg, Klein & Bilker

[57] ABSTRACT

A cooler includes a stationary side plate, a plurality of cooling pipes, a housing and an inlet and outlet cap. The cooling pipes are contained winding around in the housing, with one ends connected with the side plate closed up with the inlet and outlet cap to let A cover is fixed on an upper wall of the housing near the side plate and a hole provided in the upper wall to let hot oil coming from an oil tube fixed in the side plate to flow in the housing to move up and down along separating plates provided vertically in such a way to form an up-and-down passageway for hot oil to be cooled down and flow out of an oil exit in the bottom of the housing.

3 Claims, 4 Drawing Sheets

COOLER

BACKGROUND OF THE INVENTION

This invention relates to a cooler, particularly to one contained in an oil tank or a compresses air tank to minimize the dimensions of the cooler exposed out after installed therein, and increasing its outer clean appearance.

A conventional industrial cooler as shown in FIGS. 4 and 5 used in cooling heat produced in various machines, includes a tubular housing 11, a cooling pipe unit 12, an inlet and outlet cap 13, and an end cap 14 as main components.

The tubular housing 11 has two flanges 111 and 112 formed at two ends, a center hole 113 for containing the cooling pipe unit 12 therein. Then the inlet and outlet cap 13 is closed on the flange 111 by means of two tightening gaskets 121 and 122. Then the hat-shaped end cap 14 is closed on the flange 112 of the tubular housing 11 by means of a gasket 141 and an O-shaped ring 142, Thus cooling water flows through the inlet 131 of the inlet and outlet cap 13, into the lower portion of the cooling pipe unit 12 and then into the hat-shaped end cap 14. Then cooling water flows into the upper portion of the cooling pipe unit 12 and goes out of the outlet 132, cooling hot oil sent through the oil pipe 114 in the housing 11. In the center hole 113 of the housing 11 hot oil moves up and down along separating plates 123 disposed alternately one up and one down, receiving heat exchange process from the cooling pipe unit 12 during circulating movement therein and cooled and flows out of the exit 115. Further, the whole cooler is fixed on a table by means of foot bases 116.

However, the conventional cooler has been found to have the following drawbacks.

1. A cooler is mostly attached to some machine, hardly taken into consideration at beginning of a plan for installing the machine, installed after the machine is installed. So it always protrudes out of the machine, occupying a substantive space and liable to receive some damage in transportation, and if worse, it cannot work smoothly.

2. It usually has a considerable length and diameter to weigh heavy, and before its installment, a substantive space and support frames for it has to be prepared in advance. Further, the whole machine has to be changed in its direction for altering direction of a water inlet and outlet (such as in a floating cooling pipe unit). It is very inconvenient to transport. And piping work is complicated owing to a water inlet and outlet and an oil inlet and outlet located scattered on the whole cooler. Moreover, complicated long pipes increase flowing pressure and friction of water and oil, naturally augmenting the load of the cooler, lowering cooling effect and capacity.

3. Oil may flow into the housing and directly collide on the cooling copper pipes, disfiguring and damaging the pipes owing to a long period of use. Then recessed copper pipes may cause blocking force against water and produce dirt to shorten their service life. Further, liquid in the cooler may produce noise during speedy flowing, as the cooler is mostly located outside of a machine.

4. Provided that the conventional cooler is used in a fishing boat, it may be always corroded by sea water, resulting in thinning and forming holes in the housing, only to have about one year service life so that it has to be often replaced with a new one, troublesome and burdensome to users.

5. The two sides of the conventional cooler are welded with a cap, subject to expansion and retraction with heat and coolness to give rise to rupture or out of order if worse. Then the side caps have to be removed for repair or maintenance or cleaning.

6. The inlet and the outlet of oil are in the same direction, so old oil in the cooler may remain a lot when the cooler is to be tested in operation or cleaned, or oil therein is to be replaced with new one.

7. The thickness of the housing is large to increase its service life and sufficient strength, with the dimensions and cost augmented at the same time, inconvenient for transporting.

SUMMARY OF THE DISCLOSURE

A main purpose of the invention is to offer a cooler improved in the drawbacks of the conventional coolers, having a stationary side plate for combining a cooling pipe unit and an inlet and outlet cap, and fixed immovable at one side of a housing and inserted in an oil tank or an compressed air tank so that heat may be exchanged with coolness.

Another purpose of the invention is to offer a cooler improved in the drawbacks of the conventional coolers, having inserted in the oil tank or the compressed air tank with the inlet and the outlet side cap only exposed out, beautifying its outer appearance, lessening the space needed, protected from damage in transporting, and capable to be installed horizontal or vertical.

One more purpose of the invention is to offer a cooler improved in the drawbacks of the conventional coolers, lowering productive cost and reducing piping work and thus subsequently saving labor time and material needed, and a user needs no alterations or modifications of a machine to which the cooler is needed for, to install the cooler.

BRIEF DESCRIPTION OF DRAWINGS

This invention will be better understood by referring to the accompanying drawings, wherein.

DETAILED DESCRIPTION OF THE PREFERRED EMBODIMENT

Figure 2:
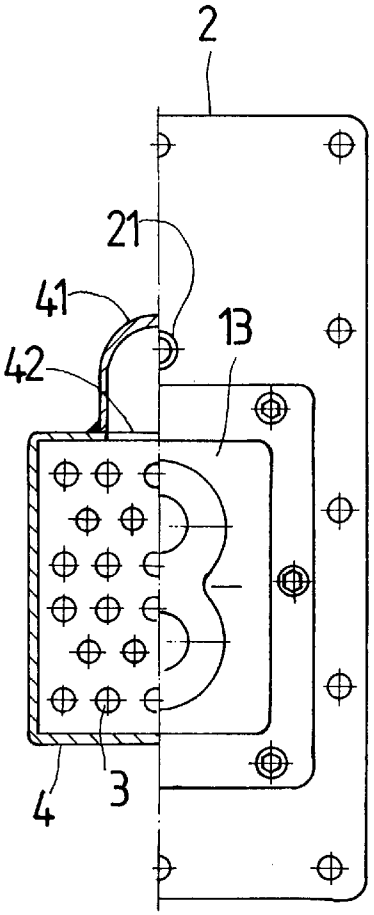
FIG. 2 is a cross-sectional view of an outer end and partial related components of the cooler of the present invention.
Figure 1:
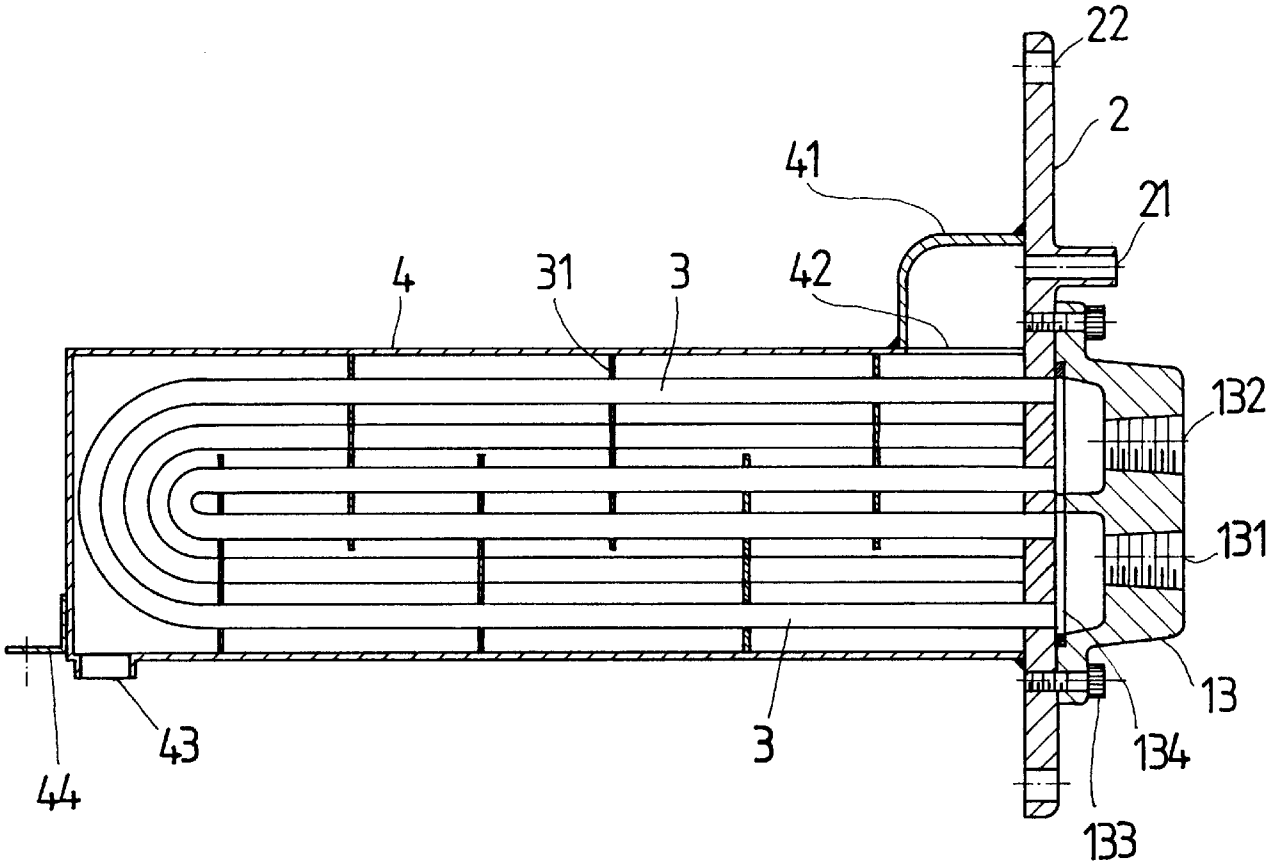
FIG. 1 is a cross-sectional view of a cooler of the present invention.

A preferred embodiment of a cooler in the present invention, as shown in FIGS. 1 and 2, includes a side plate 2, a plurality of cooling pipes 3 and a housing 4 and an inlet and outlet cap 13 used in a conventional one, as main components.

The stationary side plate 2 has an inner side combined with one end of a plurality of cooling pipes 3 circulating around in the housing 4, and an outer side combined with the inlet and outlet cap 13 by means of plural bolts 133 and a tightening gasket 134 so that cool water may enter an inlet 131 and into lower half portions of the cooling pipes 3 and then go out of an outlet 132 of the inlet and outlet cap 13.

The stationary side plate 2 is provided with an oil pipe 21 disposed at a proper location and having more than two holes, having combine holes 22 around the outer edges.

The cooling pipes 3 are combined with separating plates 31, which are vertically disposed spaced in such a manner that some separating plates 4 have upper ends fixed with an upper surface of the housing 4 and lower ends located in an intermediate portion of the interior of the housing 4 and the other neighboring separating plates 4 have lower ends fixed with a lower surface of of the housing 4 and upper ends located in the intermediate portion of the interior of the housing 4.

The housing 4 contains the cooling pipes 3 circulating around in the interior of the housing 4 and properly supported therein, and a cover 41 is provided on the housing 4 behind the oil tube 21 and a hole 42 is provided in an upper wall of the housing 4 so that hot oil coming in from the oil tube 21 may be stopped by the cover 41 and flowing down through the hole 42 into the housing 4, which is preferably shaped as a circular cross-section, but can also has other shapes. Then hot oil may flow around in the interior of the housing 4, guided by the separating plates 31 to move up and down and cooled by the cooling pipes 3 with cool water flowing therein, and finally flow out of the oil exit 43 provided in the bottom of the housing 4.

Figure 3:
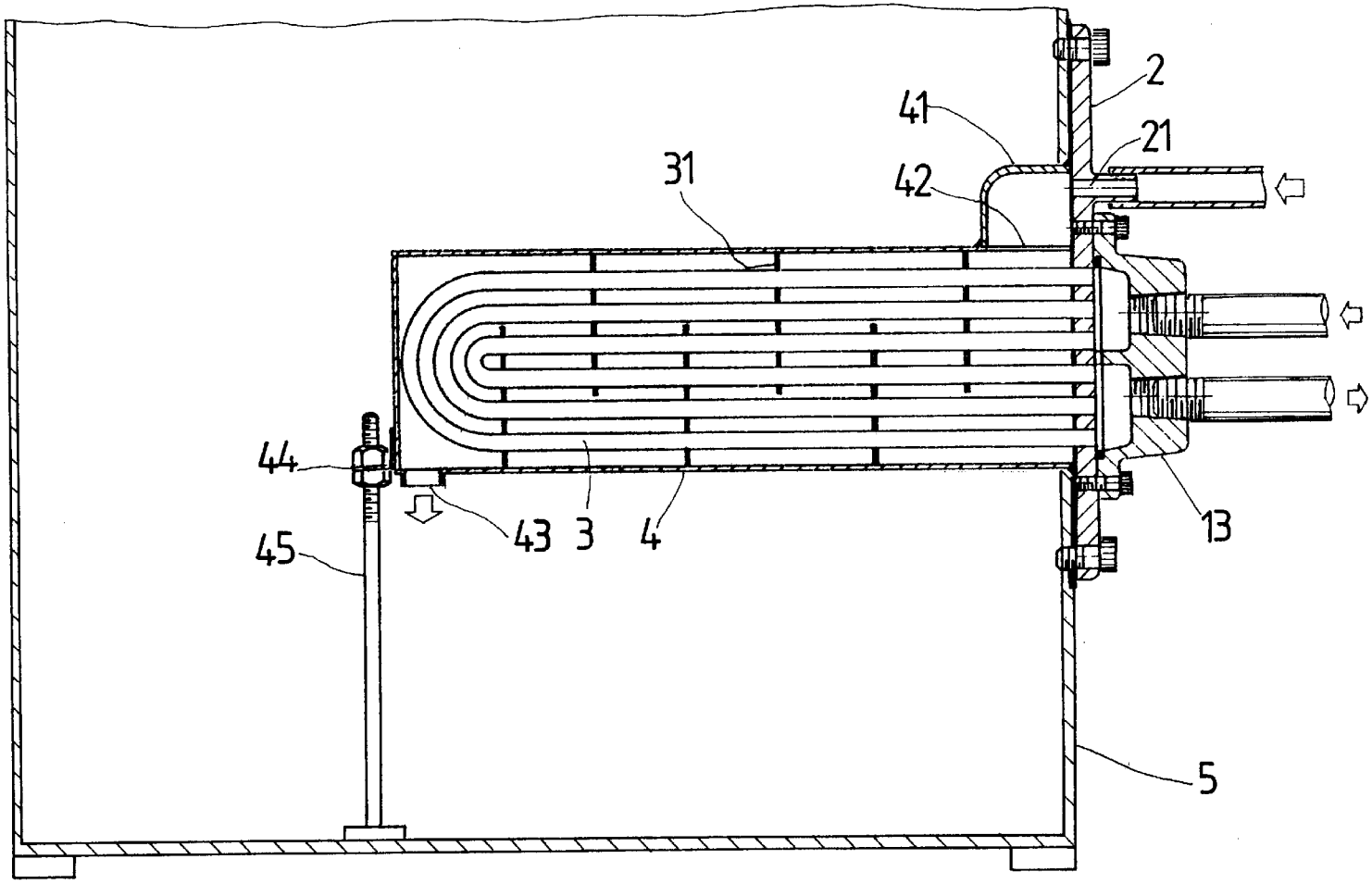
FIG. 3 is a cross-sectional view of the cooler of the present invention practically used in one way.
Figure 4:
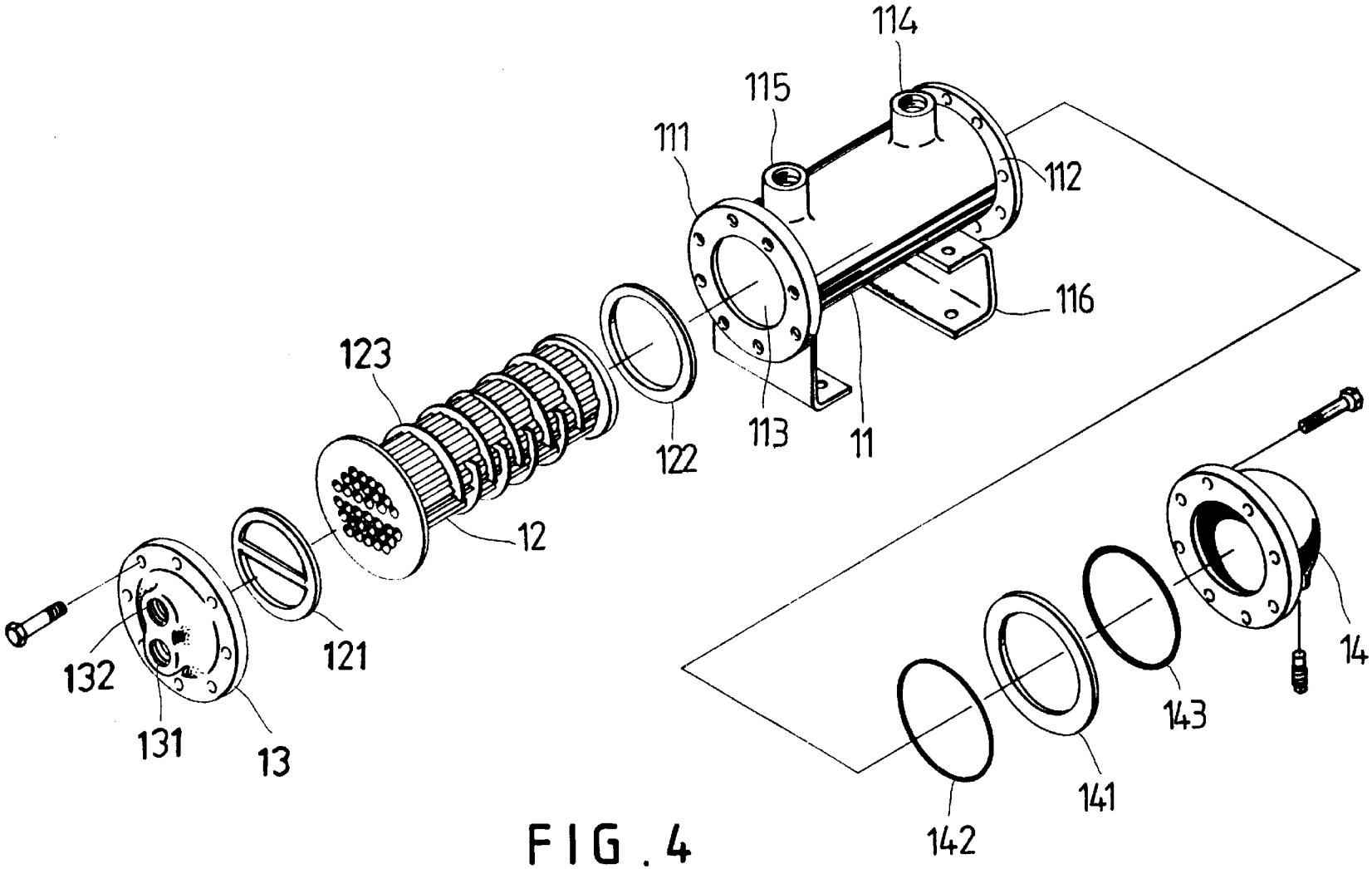
FIG. 4 (PRIOR ART)
FIG. 4 is an exploded perspective view of a conventional cooler.
Figure 5:
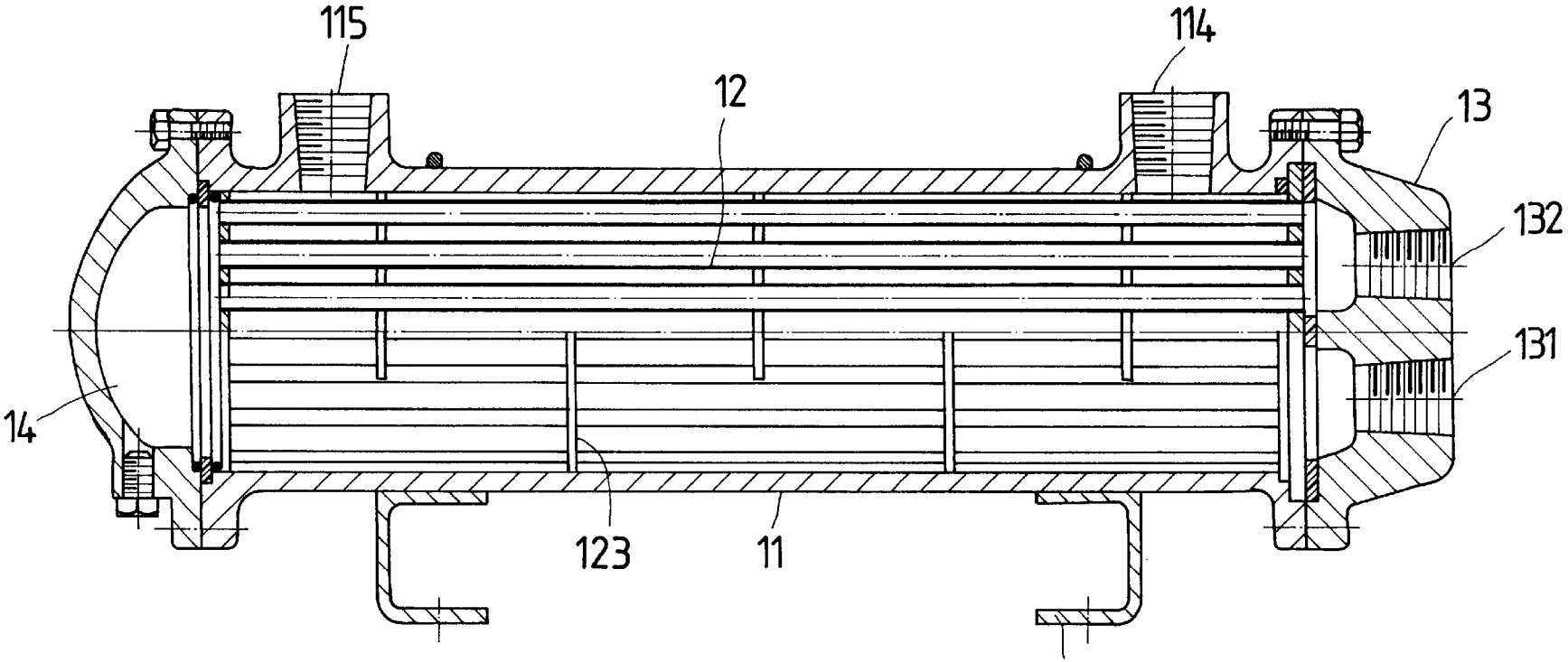
FIG. 5 (PRIOR ART)
FIG. 5 is a cross-sectional view of the conventional cooler.

Then, as shown in FIG. 3, the housing 4 together with the cooling pipes 3 is positioned in an oil tank 5 (or a compressed air tank) and tightened with screws oil-tight and air-tight. Further, the inlet 131 and the outlet 132 are respectively connected with a water supply pipe and a pump for supplying water into the cooling pipes 3. In addition, the oil tube 21 is connected with hot oil or the like, permitting hot oil to flow through the oil tube 21 into the space formed by the cover 41, through the hole 42 and then into the housing 4, letting its heat exchanged with coolness of the cooling pipes 3 and flowing out of the oil exit 43 into the oil tank 5. Further, an L-shaped support plate 44 may be fixed on an left outer side of the housing 4 for combining with an upright long bolt 45 so as to support the housing 4 from inclining.

The cooler in the present invention has the following advantages, as can be understood from the aforesaid description.

1. It can be installed in a oil tank or a compressed air tank (not exposed out as the conventional tubular housing cooler), saving much space, increasing outer beautiful appearance, and not damaged by collision with other things in transporting.

2. It can be assembled simply, quickly taken into pieces, installed horizontally or vertically.

3. Liquid flows through one or more inlets provided in the stationary flange, stopped by the cover and circulating up and down in the interior of the housing and cooled during circulation with effectively to enter the oil tank or an air tank, with hot oil not directly colliding with the cooling pipes and thus lessening disfigurement of the same pipes.

4. The cooling pipes are protected by the housing, never damaged carelessly in installing the cooler, and definitely positioned.

5. Mechanical piping can be diminished largely, saving time and material, with the cost lowered a lot, and compact with very little piping.

6. A user or a factory does not need to modify an original machine for installing the cooler in the invention.

7. The whole device is sealed inside the housing, lowering sounds of liquid flowing therein, keeping the machine silent as possible as can be, and giving rise to no problems of corrosion of the housing, which can be seen in those installed in a fishing boat, subject to sea water to corrode easily.

8. The oil in the oil tank does not sway around to give influence to balance, as the cooler is installed in the oil tank, and thus the original separating plates in the oil tank can be saved to reduce cost.

9. If the cooler is too long, its rear portion can be supported with a support rod to prevent its rear portion drooping down owing to heavy weight.

10. It has no problem of expansion by heat or contraction by coolness at one side as only the other side is fixed immovable, and thus difference of expansion and contraction may be absorbed to prevent the cooling pipes from cracking or rupturing.

11. Oil in the housing can be completely exhausted out as the oil exit is provided in the bottom thereof, in replacing oil or cleaning the housing.

12. Cleaning work is easily done by removing the inlet and outlet cap only, not needing to remove two sides as necessary in the conventional tubular housing cooler.

13. Its cooling effect is better than conventional ones because of little mechanical piping and low heat given out by the machine.

14. The housing can be thin only to separate the cooling pipes, not demanding the thickness as needed in the conventional tubular housing cooler, lowering cost and minimizing weight.

15. The whole cooler is contained in an oil tank, not only cooling with cool water but also with original cool oil in the oil tank, elevating cooling effect largely and lowering power expenditure.

While the preferred embodiment of the invention has been described above, it will be recognized and understood that various modifications may be made therein and the appended claims are intended to cover all such modifications which may fall within the spirit and scope of the invention.

What is claimed is:

1. A cooler comprising a stationary side plate, a plurality of cooling pipes, a housing containing said cooling pipes, and an inlet and outlet end cap, said inlet and outlet end cap closing on said stationary plate and having an inlet for cool water to enter lower portions and then upper portions of said cooling pipes and flowing out of an outlet of said end cap, said cooling pipes disposed to circulate in said housing, a plurality of separating plates provided vertically and spaced apart in an interior of said housing in an alternately up-and-down condition so that hot oil or a heat source flowing in said interior of said housing may be cooled by cool water flowing and circulating in said cooling pipes, and characterized by said side plate located between said end cap and right ends of said cooling pipes, said hot oil or said heat source flowing through an oil tube fixed in said stationary side plate and a hole provided in an upper side of said housing into said interior of said housing and cooled by said cooling pipes to move out of said housing into an oil tank, said cooler disposed in said oil tank and fixed firmly with and expose only one side with the other side supported in said oil tank.

2. The cooler as claimed in claim 1, wherein said housing has its inner side supported by means of a frame with an adjusting bolt standing on a bottom of said oil tank.

3. The cooler as claimed in claim 1, wherein said stationary side plate has an oil tube, which may have two or more oil holes for heat sources of different machines to flow through in said housing.

* * * * *